United States Patent [19]

Müller

[11] Patent Number: 4,754,702

[45] Date of Patent: Jul. 5, 1988

[54] SAFETY DEVICE FOR REACTING TO A WEB TEAR PARTICULARLY IN A ROLLER ROTARY OFFSET PRINTING MACHINE

[75] Inventor: Eckhard Müller, Leipzig, German Democratic Rep.

[73] Assignee: Veb Kombinat Polygraph "Werner Lamberz" Leipzig, Leipzig, German Democratic Rep.

[21] Appl. No.: 79,633

[22] Filed: Jul. 29, 1987

[30] Foreign Application Priority Data

Nov. 10, 1986 [DD] German Democratic Rep. ... 296121

[51] Int. Cl.[4] ..... B65H 23/188; B65H 16/00; B41F 13/02

[52] U.S. Cl. ..... 101/228; 101/225; 101/219; 51/273

[58] Field of Search ..... 242/74; 101/228; 226/11; 100/53; 51/273; 118/670, 672; 101/219, 225

[56] References Cited

U.S. PATENT DOCUMENTS

| | | | |
|---|---|---|---|
| 3,721,396 | 3/1973 | Morizzo | 242/74 |
| 4,133,495 | 1/1979 | Dowd | 242/74 |
| 4,508,033 | 4/1985 | Fischer | 101/228 |
| 4,611,638 | 9/1986 | Matumura | 242/74 |

FOREIGN PATENT DOCUMENTS 3215473 3/1983 Fed. Rep. of Germany .

*Primary Examiner*—Edgar S. Burr
*Assistant Examiner*—Huong Q. Pham
*Attorney, Agent, or Firm*—Michael J. Striker

[57] ABSTRACT

A safety device which quickly reacts to the occurrence of a tear in a running web processed in a rotary offset printing machine includes a suction roller onto which a web is pressed by a blast of air discharged from a row of nozzles and a pressure-voltage transducer which detects the vacuum in the suction roller and issues a signal to stop the machine or adjust the printing mechanisms in case of the occurrence of the tear in the web.

2 Claims, 2 Drawing Sheets

SAFETY DEVICE FOR REACTING TO A WEB TEAR PARTICULARLY IN A ROLLER ROTARY OFFSET PRINTING MACHINE

BACKGROUND OF THE INVENTION

The present invention relates to a safety device which reacts to the occurrence of a tear or break in a running paper web processed in rotary type roller offset printing machines, particularly those provided with printing mechanisms the damage to which must be prevented.

Due to a required relatively high paper web tension during the operation of roller rotary printing machines, an offset pressure on the rollers can easily cause tears in the web being printed on. A specific danger occurs in the region of the drier through which the web is guided over a relatively long distance in a contactless manner and where the web, due to a quick heating, is subjected to additional tensions.

Should a tear occur in a web during the operation of the rotary offset printing machine which runs with high speeds the portion of the web running until the machine is at standstill together with the web portion which is already positioned in the drier, is wound up on the cylinder of the last printing mechanism due to adhesion and decrease of web tension, whereby considerable damage can be done to bearings, cylinders and rubber cloth.

In order to avoid the aforementioned damage special devices have been proposed. One of such devices has been disclosed in DE-OS No. 32 15 473. For starting such a device a signal from web scanning elements is released upon the occurrence of a tear in the web by so-called web controllers. This signal is delivered to the electromagnet by which a detent mechanism is released by which the pivotable roller is pivoted relative to the stationary roller. The time between the release of said signal and the detection of the web is therefore relatively long.

In order to avoid this time consuming response, two rubber rollers driven with the speed approximately equal to the machine speed have been suggested in DE-PS No. 33 09 558. These rollers during a non-obstructive operation are resiliently adjusted relative to each other and are in connection with the web being printed on. These rubber rollers must be at the same time, pressure balanced. The disadvantage of this conventional device is its high cost, and, also the fact that both rollers must be moveable exactly in register with the cylinders of the printing mechanism to prevent smearing of the web. The provision of the roller rotary offset printing machines operated with high pressures with such devices is very expensive. High expense is also attributed to a required precise drive, expensive cylinder bearings, rubber tension devices and considerable wear of the rubber cloth of the rollers.

SUMMARY OF THE INVENTION

It is an object of the present invention to provide an improved safety device for reacting to the occurrence of a tear in a web being printed on.

It is another object of the invention to provide a safety device which is constructed so that damage to the printing mechanisms would be reliably prevented and the costs of which would be substantially reduced as compared to conventional devices of the foregoing type.

Yet another object of the invention is to provide a safety device by means of which signals are generated for switching off the printing machine and auxiliary aggregates if a tear occurs in the web being printed on.

These and other objects of the invetion are attained by a safety device which reacts to an occurrence of a tear in a web, particularly in rotary roller offset printing machines having printing mechanisms, the device comprising a tension roller assigned to a printing mechanism for preventing damage thereto, said roller being a driven suction roller; a suction air source; a suction air conduit connecting said source to said suction roller, said roller being positioned below the web processed and at a small distance therefrom; a row of air blast nozzles directed to the web and positioned above the web and at a small distance therefrom so that a blast air flow forced by said nozzles is directed to the web tangentially of said suction roller, said roller having a suction channel in which vacuum is generated when a flawed web is sucked by said roller when the blast air flow is applied to the web; and a pressure-voltage transducer connected to said conduit and adapted to measure said vacuum, said transducer issuing signals indicative of said vacuum and evaluated for controlling machine printing mechanisms.

The safety device of the present invention ensures that upon the occurrence of a break or tear in the web being printed on the detection of the running web and its pulling out from the printing machine before the stop of the machine is warranted within a very short period of time. At the same time, signals are produced with the safety device of the invention, which signals can shut off or somehow influence the printing machine and its aggregates.

The suction roller extends similarly to the row of the blast air nozzles, over the entire width of the web.

The suction roller can be formed of a plurality of adjacent discs of the same diameter lying one after another, over the entire width of the web.

The suction roller may be formed or driven in such a way that its peripheral speed is greater than the speed of the running web. For this purpose, the suction roller is preferably rotated with the machine speed, for example from the main drive shaft of the printing machine. The suction roller either has the same diameter as that of the rubber cylinder of the printing mechanism and the rotational speed therebetween is changed or the suction roller has the rotational speed equal to that of the rubber cylinder but the diameter greater than that of the rubber cylinder.

Such a distance in the vertical direction is provided between the row of the blast air nozzles and the suction roller that smearing of the web is avoided during its running. When a tear in the web occurs, for example in the region of the drier the tension of the web in this region is quickly reduced. This occurs particularly due to the force of the blasting air discharged from the row of nozzles and continually acting on the upper surface of the web, supported by the own weight of the web and, also due to the suction continually acting on the underside of the web for a quick placing of the flawed portion of the web onto the suction roller. The vacuum quickly built up in the suction air conduit is measured or registered by the pressure-voltage transducer, and upon exceeding of an adjustable limit value the signal indicative of that vacuum is transmitted, in the known fashion into an electrical signal. It is possible that for example with this electrical signal "an emergency" signal of the machine can be actuated so as to adjust the rubber cylinders, open the drier, etc. Therefore a satisfactory running of the web until the stop of the machine is provided by the suction roller, and the web can be pulled out from the printing machine.

Since the time difference between the occurrence of the tear in the web and the moment of registering of the aforementioned vacuum in the suction air conduit takes place the speed of the web end is substantially adjusted, which is advantageous because it is possible to adjust the flow of blasting air discharged from the row of nozzles to be sufficiently large and to select the direction of the flow to be perpendicular to the plane of the running web and tangentially of the periphery of the suction roller. Furthermore, the distance between the suction roller and the running web is chosen to be maximally as large as to prevent smearing of the web with ink.

The slightly higher peripheral speed of the suction roller relative to the speed of the web has the advantage which resides in that a small web loop occuring due to the aforementioned time difference can be quickly pulled out from the printing mechanism.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
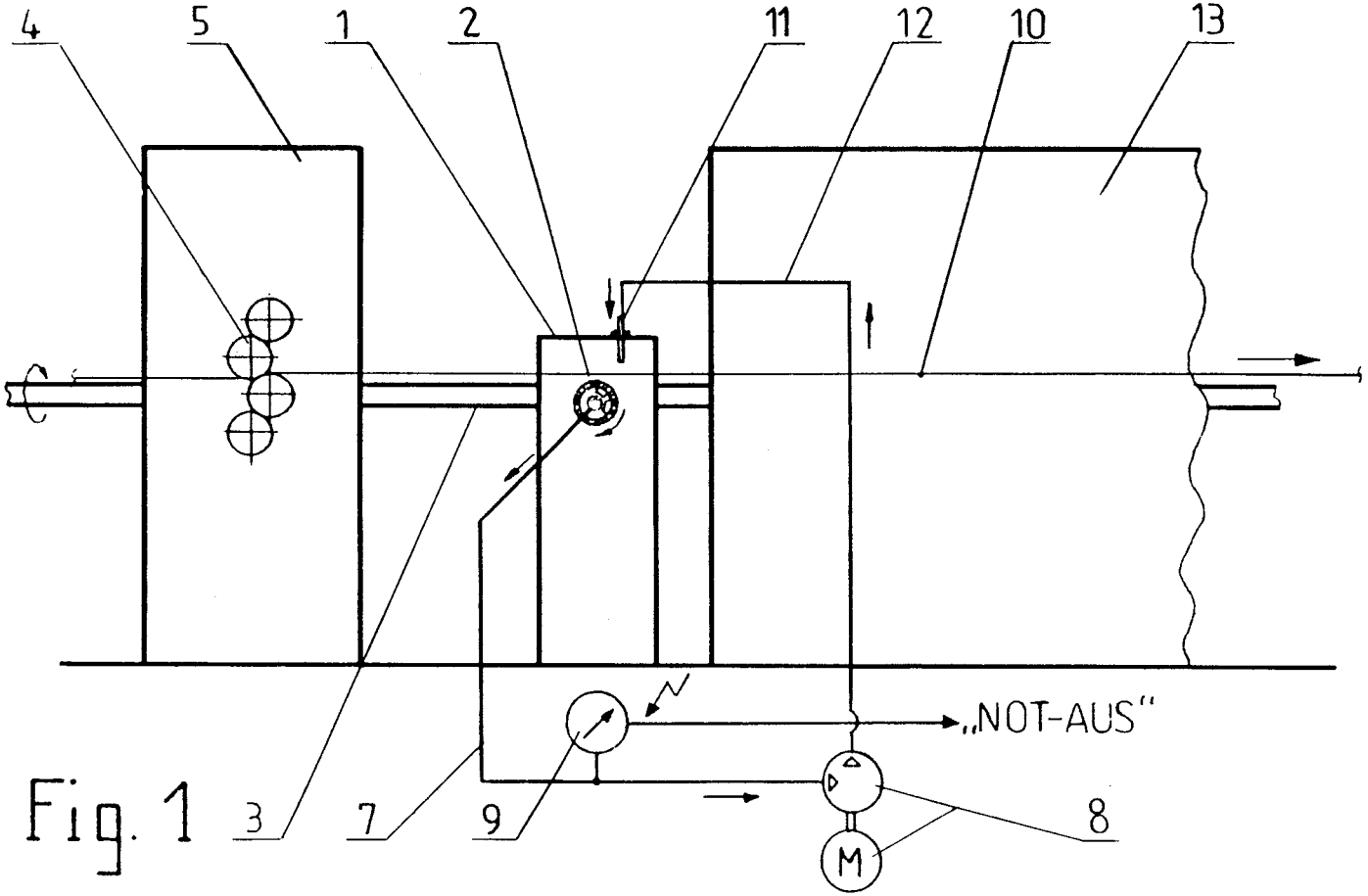
FIG. 1 is a schematic side view of the safety device of the invention, which is positioned between the last printing mechanism and the drier of the roller rotary offset printing machine.

Referring now to the drawings in detail, and firstly to FIG. 1 thereof, reference numeral 1 designates a frame in which a conventional suction roller 2 with its drive provided, preferably from a main drive shaft 3, is positioned. In order to provide that suction roller 2 have a speed greater than the speed of the web processed in the printing machine either the diameter of suction roller should be selected so that it will be greater than that of one of the rubber blanket cylinders or rollers 4 of the printing mechanism 5, or a non-shown drive train should be provided between the main drive shaft 3 and the suction roller 2, or any other transmission device should be provided between the main drive shaft 3 and rubber blanket cylinders 4.

Figure 2:
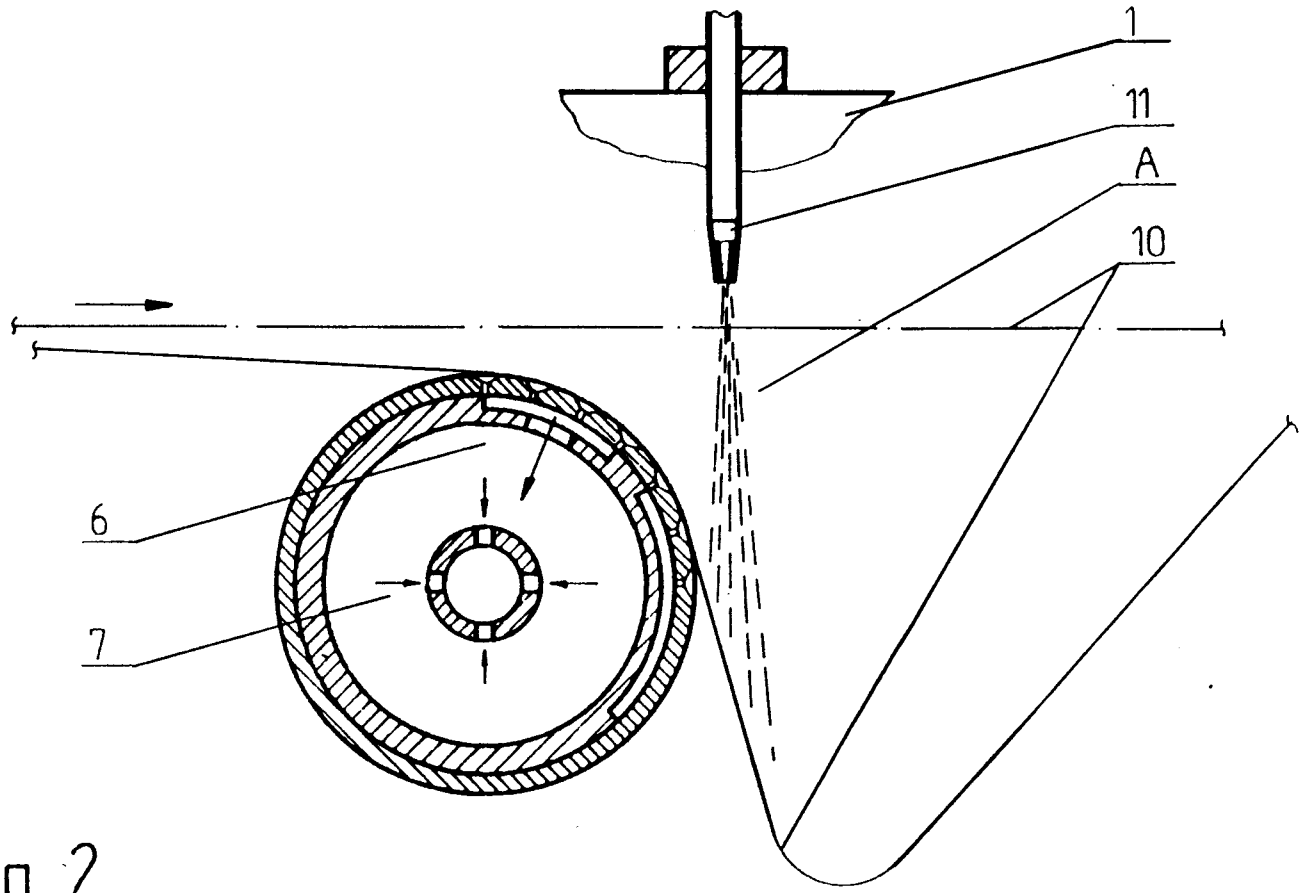
FIG. 2 is an enlarged sectional view of the suction roller and the row of air blasting nozzles.

A suction passage 6 as clearly shown in FIG. 2 is provided inside the suction roller 2. This suction passage is arranged so that it covers about 45 degrees of the circumference of the suction roller 2. The suction passage 6 is in connection with a suction compressed air source 8 shown in FIG. 1 via a suction air conduit 7. A pressure-voltage transducer 9 is positioned in the suction air conduit 7. This transducer 9 measures vacuum in the suction conduit 7 and when pressure occurs in the known fashion an electrical signal is generated by transducer 9. The suction roller 2 is positioned below web 10 and at a small distance therefrom whereas shortly behind the suction roller 2, as viewed in the direction of running of the web, and near the upper side of the web, is positioned a row of blow air nozzles 11, which row extends transversely over the entire width of the web. These nozzles 11 are in connection with a suction blow air source 8 via a blow air conduit 12. The blast air A generated by the row of nozzles 11 (FIG. 2) flows tangentially of the suction roller 2 so that web 10 in case of the occurrence of rupture is pressed against the suction roller 2 immediately in the region of the suction passage 6, and the web rupture can occur under the circumstances in or behind a drier 13. Also, the weight of the web 10 and the suction of roller 2 contribute to a quick reaction to the occurrence of the tear or rupture in the web 10. This takes place immediately during the lowering of the web tension. After overlapping of the suction roller outer face in the region of suction channel 6, vacuum is detected by the pressure-voltage transducer 9, and electrical signals issued by the transducer are utilized for the adjustment of the printing machine. The portion of the ruptured web 10 is at this point forcibly pulled by the suction roller 2 from the printing mechanism 5 as shown in FIG. 2. Thereby web 10 is not fundamentally wound up because a long period of time would be required for the removal of the roller whereas the interruption in operation should be as short as possible when the tear or rupture in the web is detected.

It will be understood that each of the elements described above, or two or more together, may also find a useful application in other types of safety devices for reacting to breaks in webs processed in printing machines differing from the types described above.

While the invention has been illustrated and described as embodied in a safety device for reacting to tears in a web processed in a printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A safety device operated to react to an occurrence of a tear in a web, particularly in rotary roller offset printing machines having printing mechanisms, the device comprising a tension roller assigned to a printing mechanism for preventing damage thereto, said roller being a driven suction roller; a suction air source; a suction air conduit connecting said source to said suction roller, said roller being positioned below the web processed and at a small distance therefrom; a row of air blast nozzles directed to the web and positioned above the web and at a small distance therefrom so that a blast air flow forced by said nozzles is directed to the web tangentially of said suction roller, said roller having a suction channel in which vacuum is generated when a flawed web is sucked by said roller when the blast air flow is applied to the web; and a pressure-voltage transducer connected to said conduit and adapted to measure said vacuum, said transducer issuing signals indicative of said vacuum and evaluated for controlling the printing mechanisms.

2. The device as defined in claim 1, wherein said suction roller is at least formed and driven so that a peripheral speed thereof is greater than a speed of the web being processed.

* * * * *